US005480757A

United States Patent [19]

Jadwin et al.

[11] Patent Number: 5,480,757

[45] Date of Patent: Jan. 2, 1996

[54] TWO COMPONENT ELECTROPHOTOGRAPHIC DEVELOPERS AND PREPARATION METHOD

[75] Inventors: Thomas A. Jadwin, Rochester; Hans W. Osterhoudt, Spencerport; John M. Spence, Mendon; Dinesh Tyagi, Fairport, all of N.Y.

[73] Assignee: Eastman Kodak Company, Rochester, N.Y.

[21] Appl. No.: 253,446

[22] Filed: Jun. 8, 1994

[51] Int. Cl.[6] ..... G03G 9/097

[52] U.S. Cl. ..... 430/110; 430/137

[58] Field of Search ..... 430/137, 106, 430/109, 110

[56] References Cited

U.S. PATENT DOCUMENTS

| | | | |
|---|---|---|---|
| Re. 31,072 | 11/1982 | Jadwin et al. . | |
| 2,229,513 | 1/1941 | Lustig | 217/60 |
| 3,547,822 | 12/1970 | Miller | 252/62.1 |
| 3,565,805 | 2/1971 | Jones et al. | 252/62.1 |
| 3,577,345 | 5/1971 | Jacknow et al. | 252/62.1 |
| 3,632,512 | 1/1972 | Miller | 252/62.1 |
| 3,795,618 | 3/1974 | Kasper | 252/62.1 |
| 3,850,663 | 11/1974 | Hagenbach | 117/17.5 |
| 3,893,935 | 7/1975 | Jadwin et al. | 252/62.1 |
| 3,898,170 | 8/1975 | Kasper | 252/62.1 |
| 3,970,571 | 7/1976 | Olson et al. | 252/62.1 |
| 4,042,518 | 8/1977 | Jones | 252/62.6 |
| 4,076,857 | 2/1978 | Kasper et al. | 427/18 |
| 4,089,472 | 5/1978 | Siegel et al. | 241/5 |
| 4,160,644 | 7/1979 | Ryan | 23/230 |
| 4,298,672 | 11/1981 | Lu | 430/108 |
| 4,312,933 | 1/1982 | Lu | 430/122 |
| 4,394,430 | 7/1983 | Jadwin et al. | 430/110 |
| 4,414,152 | 11/1983 | Santilli et al. | 430/104 |
| 4,416,965 | 11/1983 | Sandhu et al. | 260/185 |
| 4,478,925 | 10/1984 | Miskinis | 430/137 |
| 4,517,272 | 5/1985 | Jadwin et al. | 430/110 |
| 4,545,060 | 10/1985 | Arnou | 375/14 |
| 4,546,060 | 10/1985 | Miskinis et al. | 430/108 |
| 4,684,596 | 8/1987 | Bonser et al. | 430/110 |
| 4,726,994 | 2/1988 | Yoerger | 428/403 |
| 4,758,491 | 7/1988 | Alexandrovich et al. | 430/110 |
| 4,833,060 | 5/1989 | Nair et al. | 430/137 |
| 5,002,847 | 3/1991 | Utsumi et al. | 430/137 |
| 5,192,637 | 3/1993 | Saito et al. | 430/109 |
| 5,304,449 | 4/1994 | Hollenbaugh, Jr. . | |
| 5,344,738 | 9/1994 | Kmiecik-Lawrynowicz et al. | 430/137 |

FOREIGN PATENT DOCUMENTS 1117224 6/1965 United Kingdom .

*Primary Examiner*—John Goodrow

*Attorney, Agent, or Firm*—Robert Luke Walker

[57] ABSTRACT

A two component electrophotographic developer and development method. The developer includes carrier particles and toner comprising: polymeric binder; a first agent selected from the group consisting of compounds having the general structure:

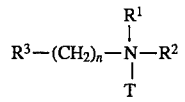

wherein n is from about 7 to about 21; $R^1$ and $R^2$ are each independently H or alkyl having from 1 to about 3 carbons; T represents an unshared electron pair or a proton and a counterion; and $R^3$ is substituted or unsubstituted alkyl, alkylamide, aryl, or heteroaryl; and a second agent comprising quaternary ammonium salt.

20 Claims, No Drawings

TWO COMPONENT ELECTROPHOTOGRAPHIC DEVELOPERS AND PREPARATION METHOD

FIELD OF THE INVENTION

The invention relates to electrographic materials and more particularly relates to a two component developer having first and second charge control and resistivity control agents and to a preparation method for that developer.

BACKGROUND OF THE INVENTION

In electrography, image charge patterns are formed on a support and are developed by treatment with an electrographic developer containing marking particles which are attracted to the charge patterns. These particles are called toner particles or, collectively, toner.

One well-known type of electrostatographic developer comprises a dry mixture of toner particles and carrier particles. Another type comprises toner particles without carrier. The former type of developer is commonly referred to as "two component developer". The latter typer of developer is commonly referred to as single component developer. This terminology can be a misnomer, for example, some two component developers contain additional small particles, which are sometimes referred to as "third component".

Two component developers are employed in cascade and magnetic brush electrostatographic development processes. The toner particles and carrier particles differ triboelectrically, such that during mixing to form the developer, the toner particles acquire a charge of one polarity and the carrier particles acquire a charge of the opposite polarity. The opposite charges cause the toner particles to cling to the carrier particles. During development, the electrostatic forces of the latent image, sometimes in combination with an additional applied field, attract the toner particles. The toner particles are pulled away from the carrier particles and become electrostatically attached, in imagewise relation, to the latent image bearing surface. The resultant toner image can then be fixed, by application of heat or other known methods, depending upon the nature of the toner image and the surface, or can be transferred to another surface and then fixed.

Electrophotography commonly uses very specialized terminology. For convenience, specialized definitions are provided here for a number of terms.

The term "particle size" used herein, or the term "size", or "sized" as employed herein in reference to the term "particles", means the median volume weighted diameter as measured by conventional diameter measuring devices, such as a Coulter Multisizer, sold by Coulter, Inc of Hialeah, Fla. Median volume weighted diameter is the diameter of an equivalent weight spherical particle which represents the median for a sample; that is, half of the volume of the sample is composed of smaller particles, and half of the volume of the sample is composed of larger particles than the median volume weighted diameter.

The term "charge control" refers to a propensity of a toner additive to modify the triboelectric charging properties of the resulting toner.

The term "glass transition temperature" or "$T_g$" as used herein means the temperature at which a polymer changes from a glassy state to a rubbery state. This temperature ($T_g$) can be measured by differential thermal analysis as disclosed in "Techniques and Methods of Polymer Evaluation", Vol. 1, Marcel Dekker, Inc., New York, 1966.

A variety of materials have been added to developers for a wide variety of purposes.

U.S. Pat. No. 3,565,805 to Jones et al teaches a developer including tackifying agents, such as siloxane oil, hydrocarbon oil, animal, fish or vegetable oil, glycerol, fatty acid ester of glycol ether or alkylamine having 12–18 carbon alkyl.

U.S. Pat. No. 3,577,345 to Jacknow et al teaches a two component developer including a solid metal salt of a fatty acid and a solid additive which can have the structural formula:

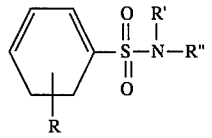

(2)

in which R is selected from H, Cl, Br, aryl, alkyl having from 1 to 6 carbons; R' and R" are selected from H, aryl having from 1 to 12 carbons and alkyl having from 1 to 12 carbons, for modifying toner melt and viscosity.

Great Britain 1,117,224 teaches the preparation of toners by a method in which surfactant is added during polymerization of binder. The patent states: "Any suitable surfactant of the well-known cationic, anionic and non-ionic types may be employed." A list of examples of surfactants includes aliphatic amines and their derivatives.

U.S. Pat. No. 4,312,933 to Lu teaches high resistivity toners for use in one component magnetic development systems. These toners include a nitrogen containing compound having the structural formula:

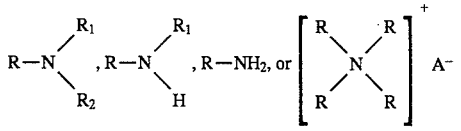

where R (or one of the R groups in the quaternary ammonium compound) is 8–22 carbon hydrocarbon, $R^1$ and $R^2$ are 1–22 carbon hydrocarbons, the remaining R groups in the quaternary ammonium compound are H or 1–22 carbon hydrocarbons, and A is sulfate, borate, chlorate or halogen.

Toner particles of two component developers often include second agents, which, desirably, provide high uniform net electrical charge to toner particles without reducing the adhesion of the toner to paper or other medium. Many types of charge control agents, materials which impart a positive charge to toner particles in a developer, have been used and are described in the published patent literature.

U.S. Pat. No. 5,002,847 to Utsumi et al teaches toners including a positive charge control agent, such as: nigrosine dyes, alkoxylated amines, quaternary ammonium salts, alkylamides, and a variety of other compounds.

U.S. Pat. No. 4,394,430 to Jadwin et al teaches a two component developer including a quaternary ammonium salt of the formula:

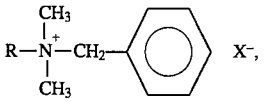

where R is 12 to 24 carbon alkyl and X is an anion.

U.S. Pat. No. 3,893,935 to Jadwin et al teaches a two component developer including a quaternary ammonium salt of the formula:

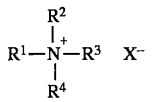

where $R^1$, $R^2$, $R^3$, and $R^4$ are 1–7 carbon alkyl and X is an anion.

U.S. Pat. No. 4,298,672 to Lu teaches a two component developer including an alkyl pyridinium compound or its hydrate of the formula:

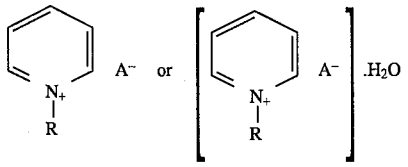

where R is 15–18 carbon hydrocarbon and A is Cl or Br.

U.S. Pat. No. 5,304,449 to Hollenbaugh, Jr., teaches toner and developers containing as charge enhancing components (1) alkyl pyridinium compounds or their hydrates and (2) tetrasubstituted ammonium salts.

In some electrophotographic applications, two component developers are needed which can maintain certain good characteristics, such as conductivity and charge control, during very long term use of the developer, in which the developer is replenished with additional toner many times. It has been determined that many additives do not maintain uniform characteristics during long term use of the developer. This presents a particular problem in very high volume applications.

It is therefore desirable to provide a two component developer and a method for preparing that developer, which developer is useful in high volume use, and which maintains good coductivity/resistivity and charging characteristics.

SUMMARY OF THE INVENTION

The invention, in its broader aspects, provides a two component electrophotographic developer and development method. The developer includes carrier particles and toner comprising: polymeric binder; a first agent selected from the group consisting of compounds having the general structure:

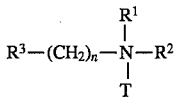

wherein n is from about 7 to about 21; $R^1$ and $R^2$ are each independently H or alkyl having from 1 to about 3 carbons; T represents an unshared electron pair or a proton and a counterion; and $R^3$ is substituted or unsubstituted alkyl, alkylamide, aryl, or heteroaryl; and a second agent comprising quaternary ammonium salt.

It is an advantageous effect of at least some of the embodiments of the invention that a two component developer and preparation method are provided, which developer is useful at high copy volumes and which maintains conductivity/resistivity within a selected range, and in addition maintains good charging characteristics.

DESCRIPTION OF PARTICULAR EMBODIMENTS

The two component developer of the invention has, in addition to carrier, toner containing binder, and two additional materials. Each material affects both charge control and conductivity and thus could be referred to as a conductivity and charge control agent. As a matter of convenience, the two materials will be referred to herein as "first agent" and "second agent". The terms "first" and "second" are arbitrary and should not be understood as to relate to any quantitative characteristic of the two materials.

The first agent has the general structure:

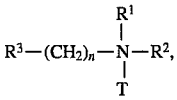

n is from about 7 to about 21, or preferably from 11 to 19. $R^1$ and $R^2$ are each independently H or alkyl having from 1 to about 3 carbons. In currently preferred embodiments of the invention, n is from 15 to 19, or more preferrably 17; and $R^1$ and $R^2$ are each H or alkyl having from 1 to about 3 carbons, or more preferably H or $CH_3$.

T represents an unshared electron pair or a proton and a counterion. In the former case, where T is an electron pair, the first agent can also be represented by the structural formula:

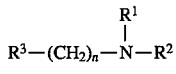

In the latter case, where T is a proton and counterion, the first agent can also be represented by the structural formula:

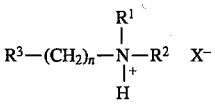

It is currently preferred that T represents a proton and a halide ion, and more preferably, a proton and a chloride ion.

$R^3$ is alkyl, aryl, or heteroaryl and can be unsubstituted or can be substituted by groups that do not cause a deleterious effect upon the overall characteristics of the first agent. For example, $R^3$ cannot react with T. Examples of $R^3$ groups include hydroxyl, amide, aryl, and alkyl. In a particular embodiment of the invention, the first agent has the general structure:

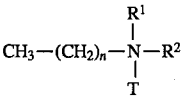

where $R^1$, $R^2$, T, and n have the same meanings as above discussed.

Specific examples of the first agent include: octadecylamine, dimethyloctadecylamine, octadecylamine hydrochloride, and dimethyloctadecylamine hydrochloride.

The second agent is a quaternary ammonium salt having the general structure:

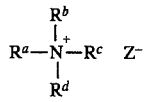

$R^a$ is aliphatic or aromatic. $R^b$, $R^c$ and $R^d$ are each independently selected from: aliphatic groups and aromatic groups; or $R^b$, $R^c$ and $R^d$ are the atoms and paired electrons necessary to complete a heteroaromatic ring system. It is preferred that the ammonium salt have at least one alkyl substituent having from 1 to about 20 carbons. Z is an anion. Suitable anions include halides, preferrably chloride; and aromatic sulfonate anions such as m-nitrobenzene sulfonate ion.

Specific examples of second agents include: second agents in which Z is halide and $R^a$, $R^b$, $R^c$, and $R^d$ are each unsubstituted straight chain alkyl groups having from 1 to 20 carbons, such as dioctadecyl dimethyl ammonium chloride; sulfonate salts of the general structure,

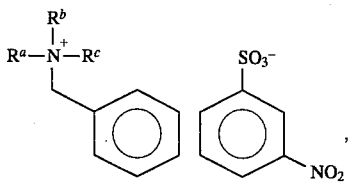

in which at least one of $R^b$, $R^c$, and $R^d$ bears an aryl substituent, such as dimethyl octadecyl benzyl ammonium m-nitrobenzene sulfonate; heteroaromatic compounds in which $R^a$ is 14 to 20 carbon alkyl, and $R^b$, $R^c$ and $R^d$ complete a heteroaromatic ring or system of 2 or 3 fused five or six membered rings, such as alkyl pyridinium halides, like cetyl pyridinium chloride, having the general structure:

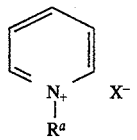

where $R^a$ is 14 to 20 carbon alkyl and X is halide.

The first agent and second agent are each present in amounts effective, in combination, to improve the properties of the developer. The first and second agents improve the charging characteristics of the developer, so the toner quickly charges to a positive value having a relatively large absolute magnitude and then maintains about that same level of charge during long term use of the developer. The first and second agents improve the conductivity characteristics of the developer so that a conductivity within a desired range is quickly attained and is then maintained throughout long term use of the developer. Surprisingly, in the developer of the invention, charging and conductivity correlate with the concentration of both the first and second agents, in a manner which permits easy "customization" of a developer for a use having particular requirements for conductivity and charge control. In a particular embodiment of the invention, the toner rapidly attains and maintains a charge (Q/m) of about 8 to 35 microculombs/gram and a resistance of about 5 to 10 log-ohms. The first and second agents also insure that substantially all of the individual toner particles exhibit a triboelectric charge of the same sign with respect to the carrier.

The properties of the thermoplastic polymers employed as the toner matrix phase in the developer of the invention can vary widely. Preferably, amorphous toner polymers having a glass transition temperature in the range of about 50° C. to about 120° C. or blends of substantially amorphous polymers with substantially crystalline polymers having a melting temperature in the range of about 65° C. to about 200° C. are utilized in the present invention.

Polymers useful as binders in the toner of the invention include styrenic/acrylic copolymers, polyesters, diolefin polymers, polyamides, epoxies, polyurethanes, and vinyl resins. Suitable vinyl resins include homopolymers or copolymers of two or more vinyl monomers. Examples of vinyl monomeric units are styrene, p-chlorostyrene, vinyl naphthalene, vinyl chloride, and ethlenically unsaturated mono-olefins such as ethylene, propylene, butylene, and isobutylene; vinylesters such as vinyl acetate, n-butyl acrylate, isobutyl acrylate, dodecyl acrylate, n-octyl acrylate, 2-chloroethyl acrylate, phenyl acrylate, methylalphachloroacrylate, methyl methacrylate, ethyl methacrylate, and butyl methacrylate; acrylonitrile, methacrylonitrile, and acrylamide; vinyl ethers such as vinyl methyl ether, vinyl isobutyl ether, and vinyl ethyl ether; vinyl ketones like vinyl methyl ketone, vinyl hexyl ketone, and methyl isopropenyl ketone; styrene butadiene copolymers including suspension polymerized styrene butadienes; and mixtures of these polymers.

Particularly desirable are styrenic/acrylic copolymers. In general, preferred styrenic/acrylic copolymers have a glass transition temperature in the range of about 50° C. to about 100° C. In a particular embodiment of the invention, the resin is a copolymer of styrene and butyl acrylate, crosslinked with divinyl benzene; produced in a suspension or emulsion polymerization process. An initiator and, optional, a chain transfer agent are used in the synthesis. The ratio of styrene to butyl acrylate is in the range of from 90:10 to 60:40 and the divinyl benzene is used at a level of 0.1 to 1.0 weight percent. In a particular embodiment of the invention, the binder is a polymer disclosed in U.S. patent application Ser. No. 08/255,522, entitled "Particulate Polymer, Electrophotographic Toner, and Preparation Methods", filed contemporaneously with this application by Sorriero et al, which is hereby incorporated herein by reference.

An optional but preferred component of the toner is colorant: a pigment or dye. Suitable dyes and pigments are disclosed, for example, in U.S. Reissue Pat No. 31,072 and in U.S. Pat. Nos. 4,160,644; 4,416,965; 4,414,152; and 2,229,513. One particularly useful colorant for toners to be used in black and white electrostatographic copying machines and printers is carbon black. Colorants are generally employed in the range of from about 1 to about 30 weight percent on a total toner powder weight basis, and preferably in the range of about 2 to about 15 weight percent.

The toner can also contain other additives of the type used in previous toners, including magnetic pigments, leveling agents, surfactants, stabilizers, and the like. The total quantity of such additives can vary. A present preference is to employ not more than about 10 weight percent of such additives on a total toner powder composition weight basis. In a particular embodiment of the invention a waxy or olefinic additive is used at a concentration of about 0 to 2 weight percent relative to the weight of binder.

Dry styrenic/acrylic copolymer toners can optionally incorporate a small quantity of low surface energy material, as described in U.S. Pat. Nos. 4,517,272 and 4,758,491. Optionally the toner can contain a particulate additive on its surface such as the particulate additive disclosed in U.S. Pat. No. 5,192,637.

The conductivity control and second agents are incorporated into the toner. The agents can be mixed into the toner in any convenient manner, such as blending in the manner described in U.S. Pat. Nos. 4,684,596 and 4,394,430, with an appropriate polymeric binder material and any other desired addenda. The mixture is then ground to desired particle size to form a free-flowing powder of toner particles containing the first agent and second agent.

A preformed mechanical blend of particulate polymer particles, second agents, colorants and additives can, alternatively, be roll milled or extruded at a temperature sufficient to melt blend the polymer or mixture of polymers to achieve a uniformly blended composition. The resulting material, after cooling, can be ground and classified, if desired, to achieve a desired toner powder size and size distribution. For a polymer having a $T_g$ in the range of about 50° C. to about 120° C., or a $T_m$ in the range of about 65° C. to about 200° C., a melt blending temperature in the range of about 90° C. to about 240° C. is suitable using a roll mill or extruder. Melt blending times, that is, the exposure period for melt blending at elevated temperature, are in the range of about 1 to about 60 minutes. Grinding can be carried out by any convenient procedure. For example, the solid composition can be crushed and then ground using, for example, a fluid energy or jet mill, such as described in U.S. Pat. No. 4,089,472. Classification can be accomplished using one or two steps.

In place of blending, the polymer can be dissolved in a solvent in which the second agents and other additives are also dissolved or are dispersed. The resulting solution can be spray dried to produce particulate toner powders. Limited coalescence polymer suspension procedures as disclosed in U.S. Pat. No. 4,833,060 are particularly useful for producing small sized, uniform toner particles.

The toner particles have an average diameter between about 0.1 micrometers and about 100 micrometers, and desirably have an average diameter in the range of from about 1.0 micrometers and 30 micrometers for currently used electrostatographic processes. The size of the toner particles is believed to be relatively unimportant from the standpoint of the present invention; rather the exact size and size distribution is influenced by the end use application intended. So far as is now known, the toner particles can be used in all known electrostatographic copying processes.

The developers of the invention include carrier and toner. The carrier can be any of a variety of conductive materials; for example: particles of elemental metal or alloy or oxide such as iron, steel, nickel, carborundum, cobalt, oxidized iron and mixtures of such materials. Examples of carriers are disclosed in U.S. Pat. Nos. 3,850,663 and 3,970,571. Especially useful in magnetic brush development procedures are iron particles such as porous iron, particles having oxidized surfaces, steel particles, and other "hard" and "soft" ferromagnetic materials such as gamma ferric oxides or ferrites of barium, strontium, lead, magnesium, or aluminum. Such carriers are disclosed in U.S. Pat. Nos. 4,042,518; 4,478,925; and 4,546,060. Carrier particles can be uncoated or can be coated with a thin layer of a film-forming resin to establish the correct triboelectric relationship and charge level with the toner employed. Examples of suitable resins are the polymers described in U.S. Pat. Nos. 3,547,822; 3,632,512; 3,795,618 and 3,898,170 and Belgian Patent No. 797,132. Other useful resins are fluorocarbons such as polytetrafluoroethylene, poly(vinylidene fluoride), mixtures of these, and copolymers of vinylidene fluoride and tetrafluoroethylene. See for example, U.S. Pat. Nos. 4,545,060; 4,478,925; 4,076,857; 4,726,994; and 3,970,571. Polymeric fluorocarbon coatings can aid the developer to meet the electrostatic force requirements mentioned above by shifting the carrier particles to a position in the triboelectric series different from that of the uncoated carrier core material to adjust the degree of triboelectric charging of both the carrier and toner particles. The polymeric fluorocarbon coatings can also reduce the frictional characteristics of the carrier particles in order to improve developer flow properties; reduce the surface hardness of the carrier particles to reduce carrier particle breakage and abrasion on the photoconductor and other components; reduce the tendency of toner particles or other materials to undesirably permanently adhere to carrier particles; and alter electrical resistance of the carrier particles.

In a preferred embodiment of the invention, the carrier is sponge iron, which is sieved, oxidized and coated with fluorocarbon on a 0.2 weight percent basis.

In a particular embodiment, the developer of the invention contains from about 1 to about 20 percent by weight of toner and from about 80 to about 99 percent by weight of carrier particles. Usually, carrier particles are larger than toner particles. Conventional carrier particles have a particle size of from about 5 to about 1200 micrometers and are generally from 20 to 200 micrometers.

The developer of the invention can be used in a variety of ways to develop electrostatic charge patterns or latent images. Such developable charge patterns can be prepared by a number of methods and are then carried by a suitable element. The charge pattern can be carried, for example, on a light sensitive photoconductive element or a non-light-sensitive dielectric surface element, such as an insulator coated conductive sheet. One suitable development technique involves cascading developer across the electrostatic charge pattern. Another technique involves applying toner particles from a magnetic brush. This technique involves the use of magnetically attractable carrier cores. After image-wise deposition of the toner particles the image can be fixed, for example, by heating the toner to cause it to fuse to the substrate carrying the toner. If desired, the unfused image can be transferred to a receiver such as a blank sheet of copy paper and then fused to form a permanent image.

The invention is further illustrated by the following Examples and Comparative Examples. Unless otherwise indicated, all starting materials were commercially obtained. The following procedures were utilized in the Examples and Comparative Examples to evaluate the developers produced.

EXAMPLES 1–9 AND COMPARATIVE EXAMPLES A–H

Developers of the invention were prepared as follows:

Poly(styrene-co-butyl acrylate-co-divinylbenzene) binder synthesis:

An organic phase was prepared by combining divinyl benzene (1.40 grams), t-dodecanethiol (1.50 grams), azo-bis pentanenitrile (4 grams), styrene (160 grams), and butyl acrylate (40 grams). An aqueous phase was prepared by combining distilled water (400 grams), potassium dichromate ((0.10 grams), poly(n-methylaminoethanol)adipate (2 grams: as 20 grams of 10 weight/weight percent solution in distilled water), and Ludox™ brand colloidal silica marketed by E. I. du Pont de Nemours (2 grams: as 4 grams of a 50 weight/weight percent dispersion in distilled water). The organic and aqueous phases were emulsified using a high shear mixing device, a Microfluidizer™ marketed by Microfluidics Corp. of Newton, Mass. The resulting emulsion was placed in a three necked round bottom flask equipped with a mechanical stirrer, condenser, and nitrogen inlet. The flask was placed in a constant temperature bath at 77° C. for 16 hours under continuous stirring. The flask was then vented, flushed with argon and heated to 85° C. for another three hours. The resulting polymer was filtered, washed, and dried.

Preparation of toner:

A dry blend was prepared of (1) 100.0 grams of poly-(styrene-co-butylacrylate-co-divinyl benzene) binder; (2) carbon black, Black Pearls 430, marketed by Cabot Corp. of Waltham, Mass. (as indicated in Table 1); (3) Viscol 660P polypropylene based wax marketed by Sanyo Chemical Industries of Tokyo, Japan (as indicated in Table 1); (4) first agent (as indicated in Table 2); and (5) second agent (as indicated in Table 2). The blend was placed on a two-roll compounding mill. One roll of the compounding mill was chilled with cold water and the other was set at 130°–150° C. The melt was mixed on the mill for 20 minutes, then was removed and cooled. The resulting slab was first coarse ground to 2 mm size on a laboratory mill, then finely pulverized to 5–15 micrometer size on a Trost TX jet mill.

Preparation of developer

Developer was prepared for the toners indicated above, by mixing toner particles prepared as described above at a weight concentration of 3% toner with carrier particles comprising oxidized iron particles thinly coated (approximately 0.2 percent weight/weight) with poly(vinylidene fluoride) powder marketed by Pennwalt Corp. as Kynar 301F. The volume average particle size of the carrier particles was from about 105 to 177 micrometers.

Evaluation of developer

A portion of developer consisting of 19.4 grams of carrier and 0.6 grams of toner, was placed in a 4 dram glass vial. The developer was exercised on a wrist-action shaker having a range of motion of 27 cm and an operating frequency of 2.8 hertz. After exercising for 16 hours the toner was stripped from the carrier and fresh toner was added. This procedure was repeated at total elapsed times of 32, 48, and 64 hours of exercising. Charge was then monitored, at various times from 10 seconds to one hour, by the well known Faraday cage method as the developer was shaken.

Conductivity of the developer was determined by placing five grams of the developer in an insulated cell measuring 2.7 cm in diameter and 0.8 cm in height. The cell had a conductive bottom and insulating sides. A brass plate was placed on top of the developer and a magnet was placed on top of the brass plate. A field of 84 volts was applied across the cell. The conductivity of the developer was measured as a resistance in units of log-ohms.

The procedure here has been empirically determined to correlate with long usage of developer in a copier or printer. In such usage, the toner portion of the developer is consumed and additional toner is added many times. It has been determined that for a developer to exhibit long life on a copier or printer (provision of greater than 500,000 copies without significant degradation of copy quality), the 64 hour exercised developer should maintain a charge during the one hour test of between 8.0 and 35.0 μC/g and the resistance, after shaking for one hour should be less than 10 log-ohms.

Results are presented in Table 2.

TABLE 1

| Example or Comparative Example | Black Pearls 430 carbon black (grams) | Viscol 660P polypropylene based wax (grams) |
|---|---|---|
| Example 1 | 6 | 1 |
| Example 2 | 6 | 1 |
| Example 3 | 6 | 1 |
| Example 4 | 8 | 1 |
| Example 5 | 6 | 0.5 |
| Example 6 | 6 | 1 |
| Example 7 | 6 | 1 |
| Example 8 | 6 | 1 |
| Example 9 | 6 | 1 |
| Comparative Example A | 6 | 0.5 |
| Comparative Example B | 6 | 1 |
| Comparative Example C | 6 | 1 |
| Comparative Example D | 6 | 0.5 |
| Comparative Example E | 6 | 0.5 |
| Comparative Example F | 6 | 0.5 |
| Comparative Example G | 6 | 0.5 |
| Comparative Example H | 6 | 0.5 |

TABLE 2

| Example or Comparative Example | 1st agent and 2nd agent (pph = parts per 100 parts of binder) | Acceptable charge | Acceptable resistance |
|---|---|---|---|
| Example 1 | 0.75 pph octadecylamine and 1.5 pph cetyl pyridinium chloride | YES | YES |
| Example 2 | 1 pph octadecylamine and 1 pph cetyl pyridinium chloride | YES | YES |
| Example 3 | 0.75 pph octadecylamine and 2 pph dioctadecyl dimethyl ammonium chloride | YES | YES |
| Example 4 | 1 pph octadecylamine and 2 pph dimethyl octadecyl benzyl ammonium m-nitrobenzene sulfonate | YES | YES |
| Example 5 | 0.75 pph dimethyl octadecylamine and 2 pph dimethyl octadecyl benzyl ammonium m-nitrobenzene sulfonate | YES | YES |
| Example 6 | 0.85 pph octadecylamine hydrochloride and 1.5 pph dioctadecyldimethyl ammonium chloride | YES | YES |
| Example 7 | 0.85 pph octadecylamine hydrochloride and 1.5 pph dioctadecyldimethyl ammonium methylsulfate | YES | YES |
| Example 8 | 0.85 pph octadecylamine hydrochloride and 1.5 pph TP415 quaternary ammonium charge control agent marketed by Hodogaya Chemical Co., Ltd. of Toyko, Japan | YES | YES |
| Example 9 | 0.85 pph octadecylamine hydrochloride and 1.5 pph cetyl pyridinium chloride | | |

TABLE 2-continued

| Example or Comparative Example | 1st agent and 2nd agent (pph = parts per 100 parts of binder) | Acceptable charge | Acceptable resistance |
|---|---|---|---|
| | | YES | YES |
| Comparative Example A | no first agent<br>no second agent | | |
| | | NO | — |
| Comparative Example B | no first agent<br>0.75 pph cetyl pyridinium chloride | | |
| | | YES | NO |
| Comparative Example C | no first agent<br>1.5 pph cetyl pyridinium chloride | | |
| | | YES | NO |
| Comparative Example D | 1.5 pph octadecylamine hydrochloride<br>no second agent | | |
| | | NO | YES |
| Comparative Example E | 1.0 pph octadecylamine hydrochloride<br>no second agent | | |
| | | NO | YES |
| Comparative Example F | 1.0 pph octadecylamine<br>no second agent | | |
| | | NO | YES |
| Comparative Example G | no first agent<br>2 pph dioctadecyl dimethyl ammonium chloride | | |
| | | YES | NO |
| Comparative Example H | no first agent<br>1.5 pph dimethyl octadecyl benzyl ammonium m-nitrobenzene sulfonate | | |
| | | YES | NO |

A theoretical explanation can be provided as to the invention, however, the scope of the claimed invention is not limited by a theory or explanation. Each of the first and second agents is believed to act to both control charge and to control conductivity of the developer. Separately, each of these agents can maintain good charging and conductivity characteristics in a developer during a short term use. In long term use; however, either agent alone tends to cause changes in the charge to mass ratio (Q/m) or conductivity or both. In the invention disclosed herein, surprisingly, use of both agents results in substantially stable Q/m and conductivity values throughout a long duty cycle. This is a highly unpredictable result.

While specific embodiments of the invention have been shown and described herein for purposes of illustration, the protection afforded by any patent which may issue upon this application is not strictly limited to a disclosed embodiment; but rather extends to all modifications and arrangements which fall fairly within the scope of the claims which are appended hereto:

What is claimed is:

1. A two component electrophotographic developer including carrier particles and toner particles, said toner particles each comprising a substantially uniform mixture of:

polymeric binder;

a first agent selected from the group consisting of compounds having the general structure:

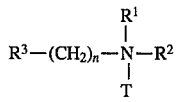

wherein n is from about 7 to about 21;

$R^1$ and $R^2$ are each independently H or alkyl having from 1 to about 3 carbons;

T represents an unshared electron pair or a proton and a counterion; and $R^3$ is substituted or unsubstituted alkyl, alkylamide, aryl, or heteroaryl; and a second agent comprising quaternary ammonium salt.

2. The developer of claim 1 wherein $R^3$ is methyl.

3. The developer of claim 1 wherein said binder is selected from the group consisting of styrene-butyl-acrylate copolymers.

4. The developer of claim 1 wherein said first agent has the general structure:

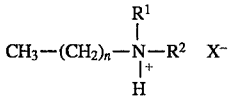

wherein $X^-$ is an anion and $R^1$ and $R^2$ are each independently H or alkyl having from 1 to about 3 carbons.

5. The developer of claim 4 wherein $X^-$ is halide, sulfonate ion, tosylate ion, or methylsulfate ion.

6. The developer of claim 4 wherein $X^-$ is $Cl^-$ or aromatic sulfonate ion.

7. The developer of claim 4 wherein n is from 11 to 19.

8. The developer of claim 4 wherein $R^1$ and $R^2$ are each independently selected from the group consisting of H and $CH_3$.

9. The developer of claim 4 wherein said first agent is octadecylamine hydrochloride and said second agent is dioctadecyl dimethyl ammonium methyl sulfonate or dimethyl octadecyl benzyl ammonium m-nitrobenzene sulfonate.

10. The developer of claim 4 wherein said second agent is an aliphatic quaternary ammonium halide or a quaternary salt of an N-alkyl substituted nitrogen heterocycle.

11. The developer of claim 4 wherein said ammonium salt is an aliphatic quaternary ammonium halide or an alkyl pyridinium halide.

12. The developer of claim 1 wherein said first agent has the general structure:

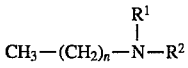

wherein $R^1$ and $R^2$ are each independently H or alkyl having from 1 to about 3 carbons.

13. The developer of claim 12 wherein n is from 11 to 19.

14. The developer of claim 12 wherein said second agent is an aliphatic quaternary ammonium halide, sulfonate, methylsulfate or tosylate or is a quaternary salt of an N-alkyl substituted nitrogen heterocycle.

15. The developer of claim 12 wherein said second agent is an aliphatic quaternary ammonium halide or an alkyl pyridinium halide.

16. A two component electrophotographic developer including carrier particles and toner particles, said toner particles each comprising a substantially uniform mixture of:

polymeric binder;

a first agent selected from the group consisting of compounds having the general structure:

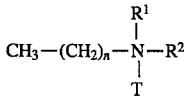

wherein n is from about 7 to about 21, $R^1$ and $R^2$ are each independently H or alkyl having from 1 to about 3 carbons, and T represents an unshared electron pair or a proton and a counterion; and a second agent selected from the group consisting of quaternary ammonium salts having the general formula:

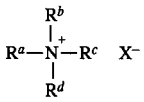

wherein $R^a$, $R^b$, $R^c$, and $R^d$ are each alkyl having from 1 to about 21 carbons, or $R^a$ is alkyl having from 1 to carbons and $R^b$, $R^c$, and $R^d$ are atoms and electrons necessary to complete an aromatic or heteroaromatic ring system having 1 or 2 rings;

X is an anion.

17. The developer of claim 16 wherein said toner further comprises magnetic pigments.

18. The developer of claim 16 wherein said first agent is selected from the group consisting of octadecylamine, dimethyloctadecylamine, octadecylamine hydrochloride, and dimethyloctadecylamine hydrochloride; and said second agent is an alkyl pyridinium compound of the formula:

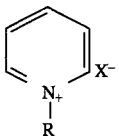

wherein

R is alkyl having from 1 to about 21 carbons, and

X is halide.

19. A method for developing latent images comprising forming an electrostatic latent image with a developer defined by claim 16, followed by transferring the image to a suitable substrate and permanently affixing the image thereto.

20. A method for preparing developer comprising the steps of:

preparing polymeric binder;

admixing said binder, a first agent selected from the group consisting of compounds having the general structure:

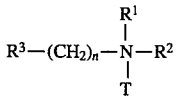

wherein n is from about 7 to about 21;

$R^1$ and $R^2$ are each independently H or alkyl having from 1 to about 3 carbons;

T represents an unshared electron pair or a proton and a counterion; and $R^3$ is substituted or unsubstituted alkyl, aryl, or heteroaryl; and a second agent selected from the group consisting of quaternary ammonium salts having the general formula:

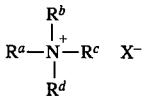

wherein $R^a$, $R^b$, $R^c$, and $R^d$ are each alkyl having from to about 21 carbons, or $R^a$ is alkyl having from 1 to carbons and $R^b$, $R^c$, and $R^d$ are atoms and electrons necessary to complete an aromatic or heteroaromatic ring system having 1 or 2 rings; and X is an anion;

to provide a substantially uniform articulate or melt blend; and pulverizing said blend.

* * * * *